US005206561A

United States Patent [19]

Oh

[11] Patent Number: 5,206,561

[45] Date of Patent: Apr. 27, 1993

[54] ELECTRON GUN FOR A COLOR CATHODE RAY TUBE

[75] Inventor: Tae-sik Oh, Pusan, Rep. of Korea

[73] Assignee: Samsung Electron Devices Co., Ltd., Kyunggi, Rep. of Korea

[21] Appl. No.: 828,229

[22] Filed: Jan. 30, 1992

[30] Foreign Application Priority Data

Jun. 7, 1991 [KR] Rep. of Korea ..... 91-9428

[51] Int. Cl.[5] ..... H01J 29/46; H01J 29/50; G09G 1/04

[52] U.S. Cl. ..... 315/15; 315/382; 313/414

[58] Field of Search ..... 315/15, 382; 313/414

[56] References Cited

U.S. PATENT DOCUMENTS 4,825,120 4/1989 Takahashi ..... 313/414

*Primary Examiner*—Gregory C. Issing

*Attorney, Agent, or Firm*—Leydig, Voit & Mayer

[57] ABSTRACT

An electron gun for a color cathode ray tube for realizing a high-quality image includes a triode having a cathode, a control electrode, and a screen electrode, and a main lens system having first to fourth focusing electrodes and an anode. The first focusing electrode and the fourth focusing electrode are electrically connected to each other, and the second focusing electrode and the third focusing electrode are electrically connected to the control electrode and the screen electrode, respectively. By forming a multistep auxiliary lens, the influence of spherical aberration and astigmatism on the electron beams are decreased and, in turn, a high-quality image can be realized.

6 Claims, 1 Drawing Sheet

ELECTRON GUN FOR A COLOR CATHODE RAY TUBE

BACKGROUND OF THE INVENTION

The present invention relates to an electron gun for a color cathode ray tube, and particularly to an electron gun for a color cathode ray tube capable of realizing a high quality image.

Generally, in accordance with methods for supplying voltage to electrodes of the focusing system, an electron gun for a color cathode ray tube can be classified as either a bipotential type or a unipotential type of a single focusing system, and a uni-bipotential focusing type of a multistep focusing system. The unibipotential focusing type electron gun is advantageous in that an electron beam can be focused by multistep focusing. However, since a high voltage of about 300 to 700V is applied to the central electrode among the electrodes constituting a unipotential type electrostatic lens, the stronger auxiliary electrostatic lens cannot be formed.

In order to solve the above-described problem, this applicant has filed Korean patent application No. 90-20987 which relates to an electron gun formed as illustrated in FIG. 1.

In more detail, the proposed electron gun is formed by a sequential arrangement of a triode consisting of a cathode 2, a control electrode 3, and a screen electrode 4; a unipotential auxiliary lens consisting of first, second, and third focusing electrodes 5, 6, and 7; and an anode 8 which forms a bipotential major lens by being positioned in the vicinity of third focusing electrode 7. In the electron gun formed as the above, the middle or second focusing electrode 6 interposing between first and third focusing electrodes 5 and 7, which constitute the unipotential auxiliary lens, is connected to control electrode 3 which is supplied.with a ground or negative potential Va'. First focusing electrode 5 and third focusing electrode 7 are supplied with a voltage Vc' of about 4 to 10KV, and screen electrode 4 is supplied with a voltage Vb' of about 400 to 1000V. Meanwhile, anode 8 is supplied with the highest voltage Vd' of about 20 to 30KV.

The characteristic of the electron gun having the above-stated structure is that control electrode 3 is connected to second focusing electrode 6, and then, a voltage of about 400 to 1000V is supplied, thereby forming a more intensified auxiliary lens. However, the obtained result is unsatisfactory by this structure, also.

SUMMARY OF THE INVENTION

It is an object of the present invention to provide an electron gun for a color cathode ray tube, which has further intensified auxiliary lens, and is improved to stably focus the electron beams.

It is another object of the present invention to provide an electron gun for a color cathode ray tube, wherein the influence of spherical aberration on an electron beam is decreased by using multiple lenses, so that a beam spot is minimized and, in turn, the resolution of an image can be enhanced.

To achieve these and other objects, there is provided an electron gun for a color cathode ray tube comprising:

a prefocusing lens comprising a screen electrode and a first focusing electrode;

an auxiliary lens comprising second, third and fourth focusing electrodes arranged sequentially, the first and fourth electodes each having a first potential, the second electrode having a second potential and the third electrode having a third potential such that the first potential is greater than the second potential and the third potential is greater than the second potential; and a major lens comprising said fourth focusing electrode and an anode, the second focusing electrode being electrically connected to a control electrode and the third focusing electrode being electrically connected to the screen electrode so that a single virtual unipotential lens is formed between the first focusing electrode and the fourth focusing electrode which causes the electron beam to be focused and accelerated in multiple steps and which decrease the influence of spherical aberration and astigmatism on the electron beam.

BRIEF DESCRIPTION OF THE DRAWINGS

These and other objects, features, aspects and advantages of the present invention will become more apparent when taken in conjunction with the accompanying drawings, in which.

DETAILED DESCRIPTION OF THE INVENTION

Figure 1:
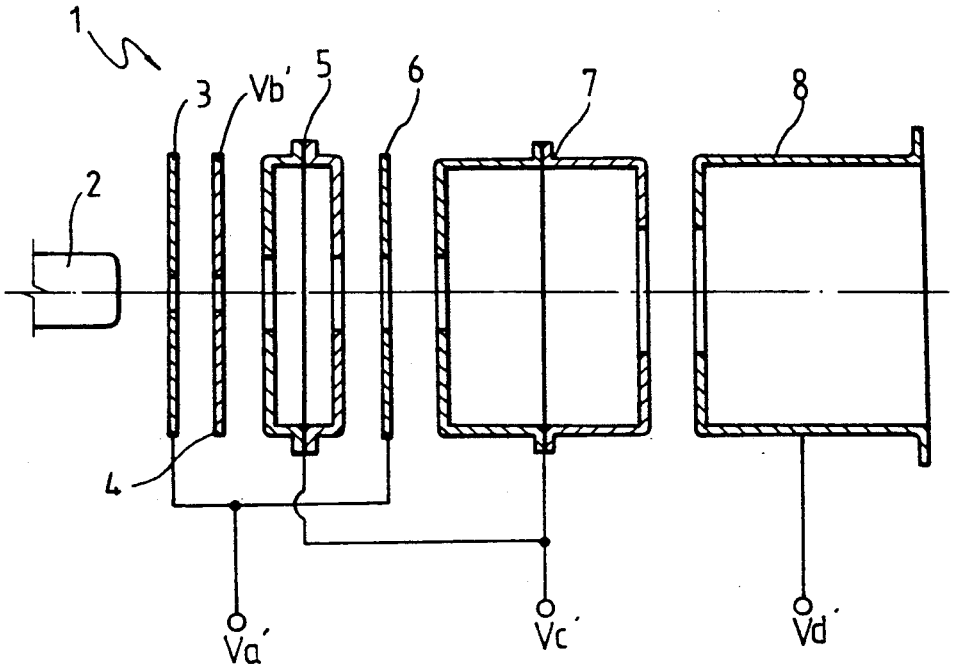
FIG. 1 (PRIOR ART)
FIG. 1 is a schematic vertical section view of a vertical conventional electron gun for a color cathode ray tube.
Figure 2:
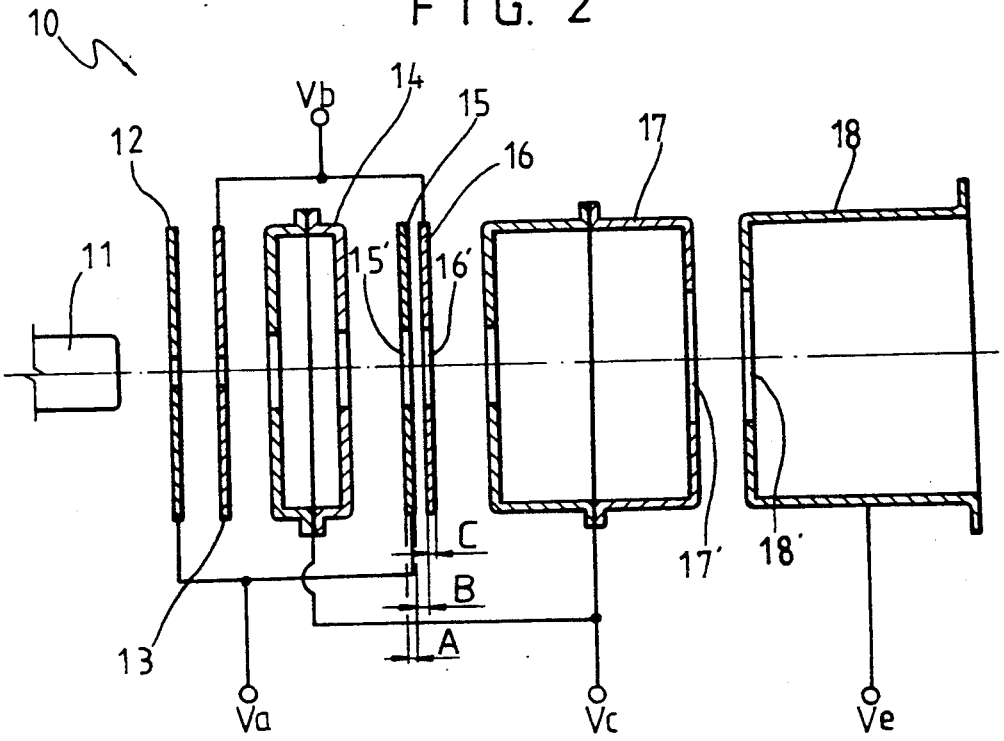
FIG. 2 is a schematic vertical section view showing an embodiment of an electron gun of a color cathode ray tube according to the present invention.

An electron gun 10 for a color cathode ray tube according to the present invention is schematically illustrated in FIG. 2. Here, a triode for producing an electron beam consists of the sequential arrangement of cathode 11 which is a source for emitting thermoelectrons, a control electrode 12 for controlling the emitted thermoelectrons, and a screen electrode 13 for focusing the controlled thermoelectrons to form an initial electron beam. Following screen electrode 13, first, second, third, and fourth focusing electrodes 14, 15, 16, and 17 which form an auxiliary lens of the main lens system are sequentially arranged. Successively, an anode 18 is provided for forming a major lens of the main lens system together with fourth focusing electrode 17.

First focusing electrode 14 and fourth focusing electrode 17 are formed such that two cup-shaped components are folded, and electrically connected to each other. Control electrode 12 is electrically connected to second focusing electrode 15, and screen electrode 13 is connected to third focusing electrode 16, which are formed of a single plate-type component.

In the electron gun having the aforesaid structure, control electrode 12 and second focusing, electrode 15 are supplied with a voltage Va of a negative or ground potential. Screen electrode 13 and third focusing electrode 16 are supplied with a voltage Vb of about 400 to 1000V. First and fourth focusing electrodes 14 and 17 are supplied with a voltage Vc of about 4 to 10KV. Anode 18 is supplied with the highest voltage Vd of about 10 to 30KV whose potential is the same as the screen of the cathode ray tube.

On the other hand, second and third focusing electrodes 15 and 16 each have electron beam passing holes 15' and 16' whose diameters are 0.6mm, and each thickness A and C, i.e., the length of the axis direction of each beam passing hole, is approximately 0.6mm. Also, a spacing B between second focusing electrode 15 and third focusing electrode 16 is 0.6 mm. Fourth focusing electrode 17 and anode 18 each have electron beam passing holes 17' and 18' whose diameters are roughly 5.5 mm.

In the above-described electron gun 10 for the cathode ray tube according to the present invention, a prefocusing lens is formed between screen electrode 13 and first focusing electrode 14. An auxiliary lens of the main lens system is formed between respective first, second, third, and fourth focusing electrodes 14 to 17, and the major lens of the main lens system is formed between fourth focusing electrode 17 and anode 18.

A bipotential-type auxiliary lens is formed by potential differences between the first and second focusing electrodes, between the second and third focusing electrodes, and between the third and fourth focusing electrodes. Since a higher voltage is commonly applied to first focusing electrode 14 and fourth focusing electrode 17 relative to the voltage supplied to second and third focusing electrodes 14 and 15 placed between them, first and fourth focusing electrodes 14 and 17 form a single unipotential auxiliary lens which consists of a plurality of minute bipotential lenses together with second focusing electrode 15 and third focusing electrode 16, and is considered as one lens.

The thermoelectrons emitted from cathode 11 are transformed into an initial electron beam by being preliminary focused and accelerated in the prefocusing lens, and focused and accelerated by multiple steps while passing through the auxiliary lens of the main lens, and then finally accelerated and focused in the major lens of the main lens. Since the auxiliary lens is composed of a plurality of bipotential lenses, the electron beam is less affected by spherical aberration while passing through the auxiliary lens of the main lens. Accordingly, the electron beam passing through the auxiliary lens is incident to the major lens of the main lens system at a narrower incident angle relative to that in the conventional structure, which is substantially effective in distancing the object point of the major lens. Therefore, the electron beam passing through the major lens is less affected by spherical aberration and astigmatism, so that, when the electron beam lands on the screen of the cathode ray tube, an optimum beam spot can be formed.

The characteristic of the above-described electron gun for the cathode ray tube of the present invention is that multistep bipotential lens is formed between equipotential first focusing electrode 14 and fourth focusing electrode 17, wherein second focusing electrode 15 connected to control electrode 12 and third focusing electrode 16 connected to screen electrode 13 are provided, thereby producing a single virtual unipotential lens between first focusing electrode 14 and fourth focusing electrode 17. With this characteristic, the electron beam generated in the triode is initially focused and accelerated by multiple steps, and then finally focused, decreasing the influence of spherical aberration and astigmatism on the electron beam. Thus, a good quality beam spot is formed on the screen. As a result, high resolution image can be realized.

What is claimed is:

1. An electron gun for a color cathode ray tube comprising:

a cathode for generating thermoelectrons;

an adjacent control electrode and screen electrode for transforming said thermoelectrons into an electron beam;

a first focusing electrode in the vicinity of said screen electrode, and a fourth focusing electrode electrically connected to said first focusing electrode;

a second focusing electrode provided between said first and fourth focusing electrodes, and electrically connected to said control electrode;

a third focusing electrode formed between said second and fourth focusing electrodes, and electrically connected to said screen electrode; and an anode adjacent said fourth focusing electrode.

2. An electron gun for a color cathode ray tube as claimed in claim 1, wherein said control electrode and said second focusing electrode are supplied with a negative or ground potential, said screen electrode and said third focusing electrode are supplied with a voltage of about 400 to 1000V, said first and fourth focusing electrodes are supplied with a voltage of about 4 to 10KV, and said anode is supplied with the highest voltage of about 20 to 30KV which is the same as that supplied to the screen of the cathode ray tube.

3. An electron gun for a color cathode ray tube as claimed in claim 1, wherein said second and third focusing electrodes each have a beam passing hole of the same diameter.

4. An electron gun for a color cathode ray tube as claimed in claim 3, wherein the diameter of the beam passing hole is 0.6 mm.

5. An electron gun for a color cathode ray tube as claimed in claim 1, wherein said second focusing electrode is separated from said third focusing electrode by a distance of 0.6 mm.

6. An electron gun for a color cathode ray tube comprising:

a prefocusing lens comprising a screen electrode and a first focusing electrode;

an auxiliary lens comprising second, third and fourth focusing electrodes arranged sequentially, the first and fourth electrodes each having a first potential, the second electrode having a second potential and the third electrode having a third potential such that the first potential is greater than the second potential and the third potential is greater than the second potential; and a major lens comprising said fourth focusing electrode and an anode, the second focusing electrode being electrically connected to a control electrode and the third focusing electrode being electrically connected to the screen electrode so that a single virtual unipotential lens is formed between the first focusing electrode and the fourth focusing electrode which causes the electron beam to be focused and accelerated in multiple steps and which decrease the influence of spherical aberration and astigmatism on the electron beam.

* * * * *